US007656144B2

(12) United States Patent
Cicalini

(10) Patent No.: US 7,656,144 B2
(45) Date of Patent: Feb. 2, 2010

(54) BIAS GENERATOR WITH REDUCED CURRENT CONSUMPTION

(75) Inventor: Alberto Cicalini, San Diego, CA (US)

(73) Assignee: QUALCOMM, Incorporated, San Diego, CA (US)

( * ) Notice: Subject to any disclaimer, the term of this patent is extended or adjusted under 35 U.S.C. 154(b) by 59 days.

(21) Appl. No.: 11/400,592

(22) Filed: Apr. 7, 2006

(65) Prior Publication Data

US 2007/0236202 A1 Oct. 11, 2007

(51) Int. Cl.
*G05F 3/16* (2006.01)
*G05F 3/20* (2006.01)

(52) U.S. Cl. ..... 323/314; 323/313; 323/315

(58) Field of Classification Search ..... 323/312, 323/313, 314, 315
See application file for complete search history.

(56) References Cited

U.S. PATENT DOCUMENTS 5,359,296 A 10/1994 Brooks et al.
7,078,958 B2 * 7/2006 Gower et al. ..... 327/539
7,148,672 B1 * 12/2006 Holmes ..... 323/316

FOREIGN PATENT DOCUMENTS

EP 1 388 776 A1 2/2004
WO 97/50026 A 12/1997

* cited by examiner

*Primary Examiner*—Bao Q Vu
(74) *Attorney, Agent, or Firm*—George C. Pappas; William M. Hooks

(57) ABSTRACT

A bias generator comprises a first transistor and a second transistor having a control port connected to a control port of the first transistor and to an input port of the second transistor, where a second current through the second transistor is greater than a first current through the first transistor. The current through the bias generator is minimized by providing the different currents through the transistors having a similar size.

18 Claims, 3 Drawing Sheets

BIAS GENERATOR WITH REDUCED CURRENT CONSUMPTION

BACKGROUND

1. Field

The present invention relates in general to bias generator circuits, and more specifically to bias generators with minimized susceptibility to environmental and manufacturing changes.

2. Background

A bias generator provides a bias voltage to a device such as transistor to allow the device to operate in a preferred region of the device operational characteristics. In many applications, the selection of the relative sizes of the transistors used in the bias generator and the load device is critical to maintain the operational characteristics within an acceptable region over variances due to temperature and manufacturing. For example, bias generators are often used to set a voltage at an input of a low noise amplifier (LNA) transistor where small changes in operational characteristics result in increased noise and non-linear input to output relationships. Since the devices used to implement bias generators are susceptible to temperature and manufacturing process variations, conventional biasing schemes attempt to minimize the effects of temperature and process fluctuations. In an attempt to maximize the performance of the biased device, conventional bias generates consume significant amounts of current relative to the current used by the biased device. Performance of bias generators typically suffers when the devices in the bias generator are mismatched from the biased device. A mismatch between devices causes time-independent random variations in physical characteristics of identically designed devices. Typical characteristics that may be different between mismatched devices include device dimensions, threshold voltage, and mobility. Performance of a bias generator is typically improved by selecting a biasing device similar to the biased device. Unfortunately, conventional biasing schemes typically require a significant tradeoff between current draw and relative device size between the biased device and the devices in the bias generator.

Therefore, there is a need for a bias generator with minimized current consumption and maximized performance.

SUMMARY

In accordance with the exemplary embodiment, a bias generator comprises a first transistor and a second transistor having a control port connected to a control port of the first transistor and to an input port of the second transistor, where a second current through the second transistor is greater than a first current through the first transistor. The current through the bias generator is minimized by providing the different currents through the transistors having a similar size.

DETAILED DESCRIPTION

In the exemplary embodiment, current through a bias generator is minimized by providing different currents through transistors having a similar size. As compared to conventional bias generators where equal current are forced through devices of different sizes, the overall current consumption of the exemplary bias generator is less. The word "exemplary" is used herein to mean "serving as an example, instance, or illustration." Any embodiment described herein as "exemplary" is not necessarily to be construed as preferred or advantageous over other embodiments.

Figure 1:
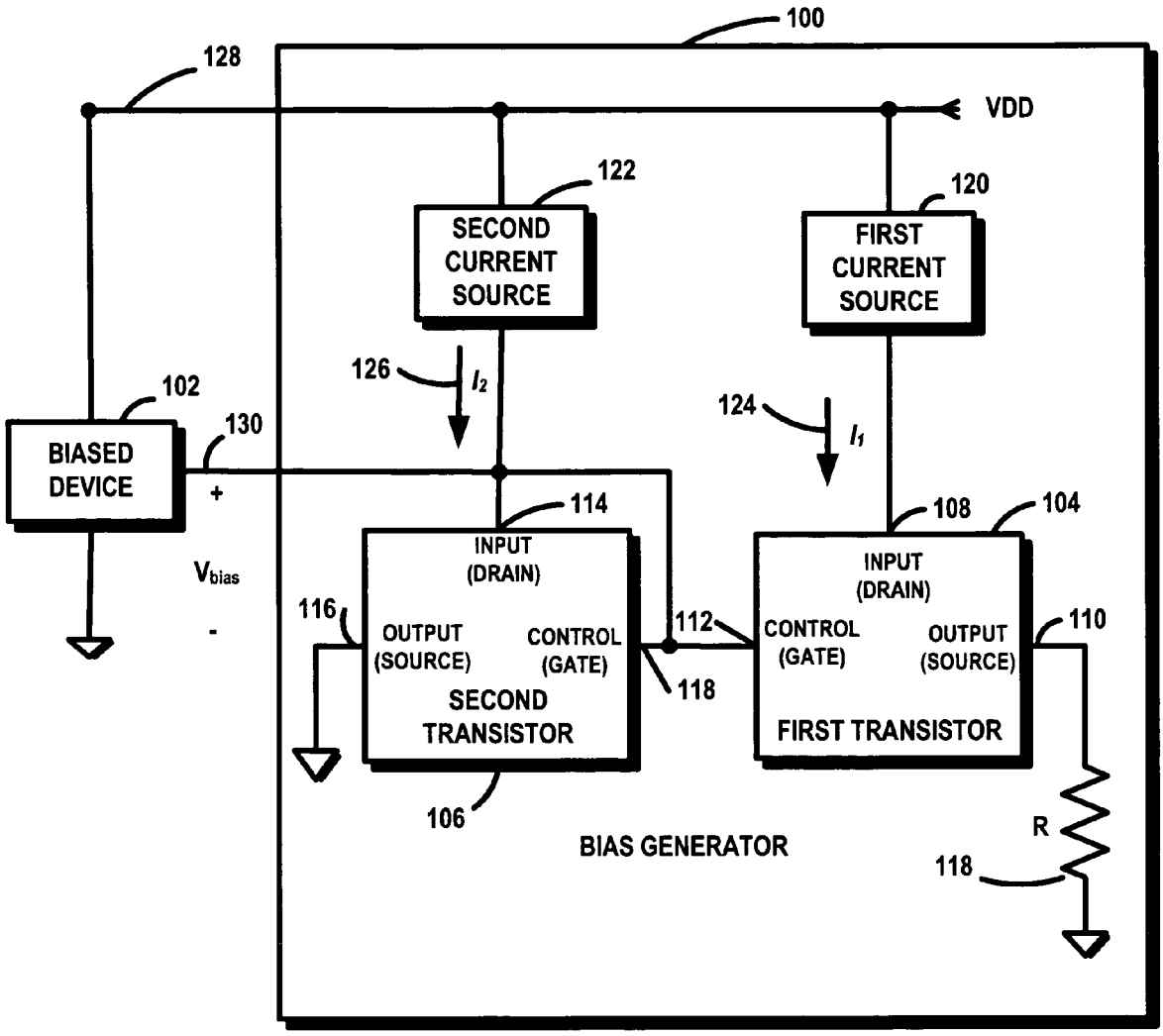
FIG. 1 is a block diagram of a bias generator connected to a biased device in accordance with an exemplary embodiment of the invention.

FIG. 1 is a block diagram of a bias generator 100 connected to a biased device 102 in accordance with the exemplary embodiment of the invention. The various functional blocks of the bias generator 100 may be implemented using any combination of discrete devices, integrated circuits and/or logic circuits. Two or more of the functional blocks may be integrated in a single device and the functions described as performed in any single device may be implemented over several devices in some circumstances.

The bias generator 100 includes at least two transistors 104, 106 that provide a bias voltage ($V_{bias}$) 130 to the biased device 102. Each of the transistors 104, 106 has an input port 108, 114, an output port 110, 116, and a control port 112, 118 where the voltage at the control port 112, 118 determines the current flow through the transistor 104, 106 from the input port 108, 114 to the output port 110, 116. Where the transistor is a field effect transistor (FET), the input port 108, 114, output port 110, 116 and control port 112, 118 are the drain, source and gate of the FET, respectively. Where the transistor is a bipolar junction transistor (BJT), the input port 108, 114, output port 110, 116 and control port 112, 118 are the collector, emitter and base of the BJT, respectively. Those skilled in the art will readily apply the teachings herein to known techniques in order to utilize any of numerous three terminal devices to implement the bias generator.

In the exemplary embodiment, the first control port 112 of the first transistor 104 is connected to the second control port 118 of the second transistor 106. The common node formed at the two control ports 112, 118 is connectable to the biased device 102 to provide the bias voltage 120 ($V_{bias}$). The first output port 110 of the first transistor 104 is connected to ground through a reference load (R) 118. A first current source 120 supplies a first current ($I_1$) 124 to the first transistor 104 from a power supply at a voltage (VDD) 128. The first current ($I_1$) 124 flows from the input port through the transistor to the output port and through the reference load 118. A second current source supplies a second current ($I_2$) to the second transistor 106. Although other devices may be used in some circumstances for implementing the current sources 120, 122, the first current source 120 and the second current source 122 are field effect transistors (FETs) in the exemplary embodiment.

In order to minimize the total current consumption while minimizing the variation of the bias voltage over temperature and manufacturing variations, the second current 122 source provides a second current ($I_2$) that is greater than the first current ($I_1$) and the difference in size between the first transistor 104 and the second transistor 106 is minimized. In the exemplary embodiment, the first transistor 104 and the second transistor 106 are selected to have the same size. As discussed below, the total current through the bias generator 100 is minimized while the performance is maximized.

Figure 2:
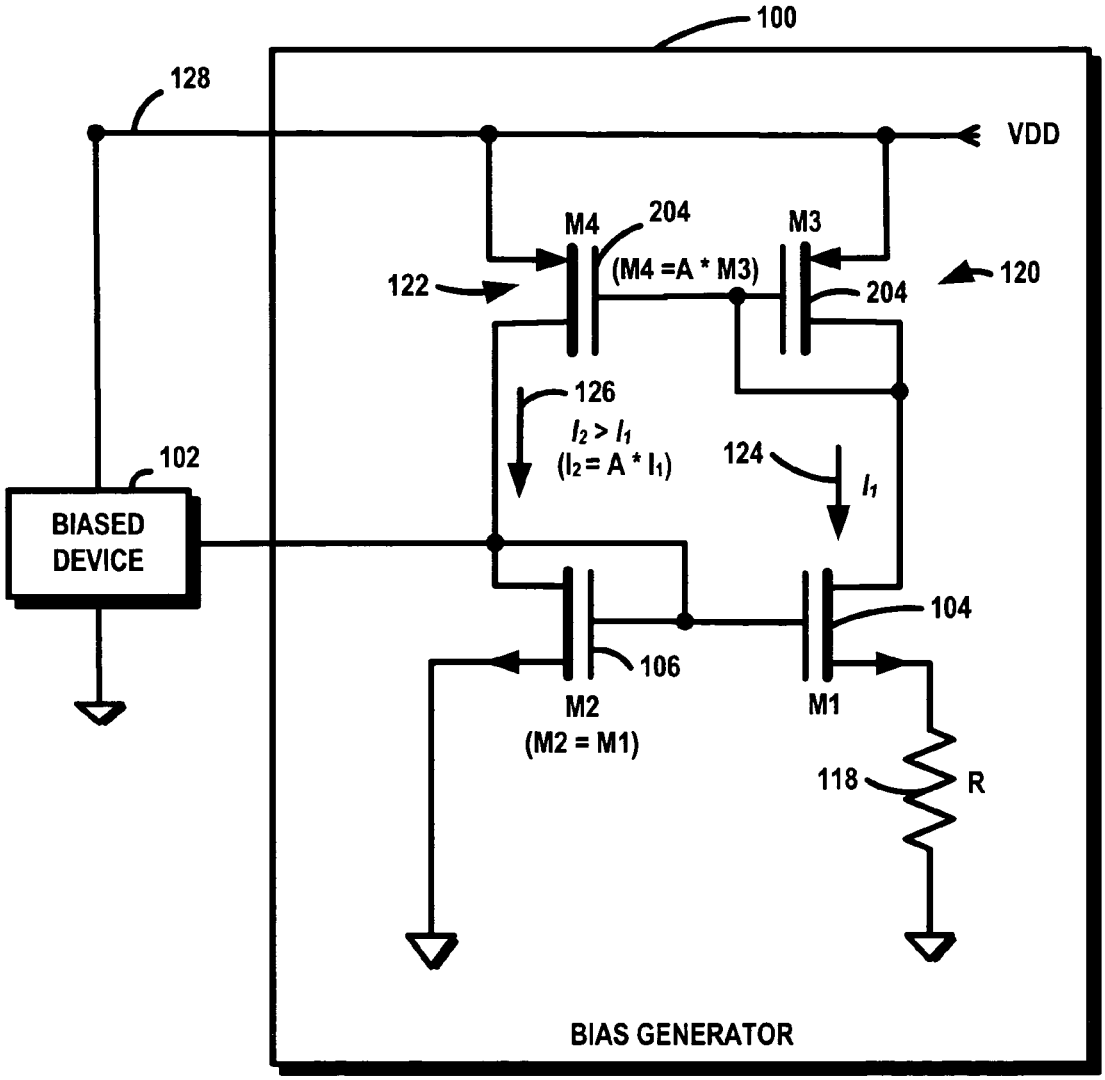
FIG. 2 is a schematic representation of the exemplary bias generator where the current sources and the transistors are field effect transistors (FETs).

FIG. 2 is a schematic representation of the exemplary bias generator 100 where the current sources 120, 122 and the transistors 104, 106 are field effect transistors (FETs). As explained above, the bias generator 100 may be implemented using BJTs or other three terminals devices.

A field effect transistor (FET) is typically fabricated using any of numerous doping techniques to create a channel in a substrate. The channel may be formed with one or more elements often referred to as "fingers". The operational characteristics of the FET depend on the aspect ratio of the fingers and the number of fingers where the aspect ratio is the ratio of the width ($W_f$) to the length ($L_f$) of the finger. The size (M) of the FET is the aspect ratio of each finger ($W_f/L_f$) time the number of fingers ($N_f$). Therefore, the size of the first transistor and the second transistor can be expressed as follows:

$$M_1 = M_2 = N_f * \frac{W_f}{L_f} \tag{1}$$

where $M_1$ is the size of the first transistor, $M_2$ is the size of the second transistor, $W_f$ is the width of each finger, $L_f$ is the length of each finger, and $N_f$ is the total number of fingers.

In the exemplary embodiment, the first current source 120 includes a third FET 202 where the gate is connected to the source and the second current source 122 includes a fourth FET 204. The first current ($I_1$) 124 and the second current ($I_2$) 126 are determined, at least in part, by the sizes ($M_3$, $M_4$) of the third FET 202 and the fourth FET 204. In the exemplary embodiment, the size of the fourth FET ($M_4$) is selected to be approximately A times the size ($M_3$) of the third FET 202 in order that the second current ($I_2$) 126 be about A times the first current ($I_1$) 124. Accordingly, for the exemplary embodiment, the following relationships apply.

$$M_4 = A * M_3 \tag{2}$$

$$I_2 = A * I_1 \tag{3}$$

$$I_2 = \frac{2}{R^2 * \mu_n * C_{ox} * N_f * \left(\frac{W_f}{L_f}\right)} * \left(\sqrt{A} - 1\right)^2 \tag{4}$$

where R is the resistance of the reference load 118, $\mu_n$ is the mobility of the FETs, $C_{ox}$ is the capacitance per area of the FETs, and $N_f$ is the number of fingers of the second transistor 106. Accordingly, the current is proportional to A, the ratio of the $M_4$ to M3.

Figure 3:
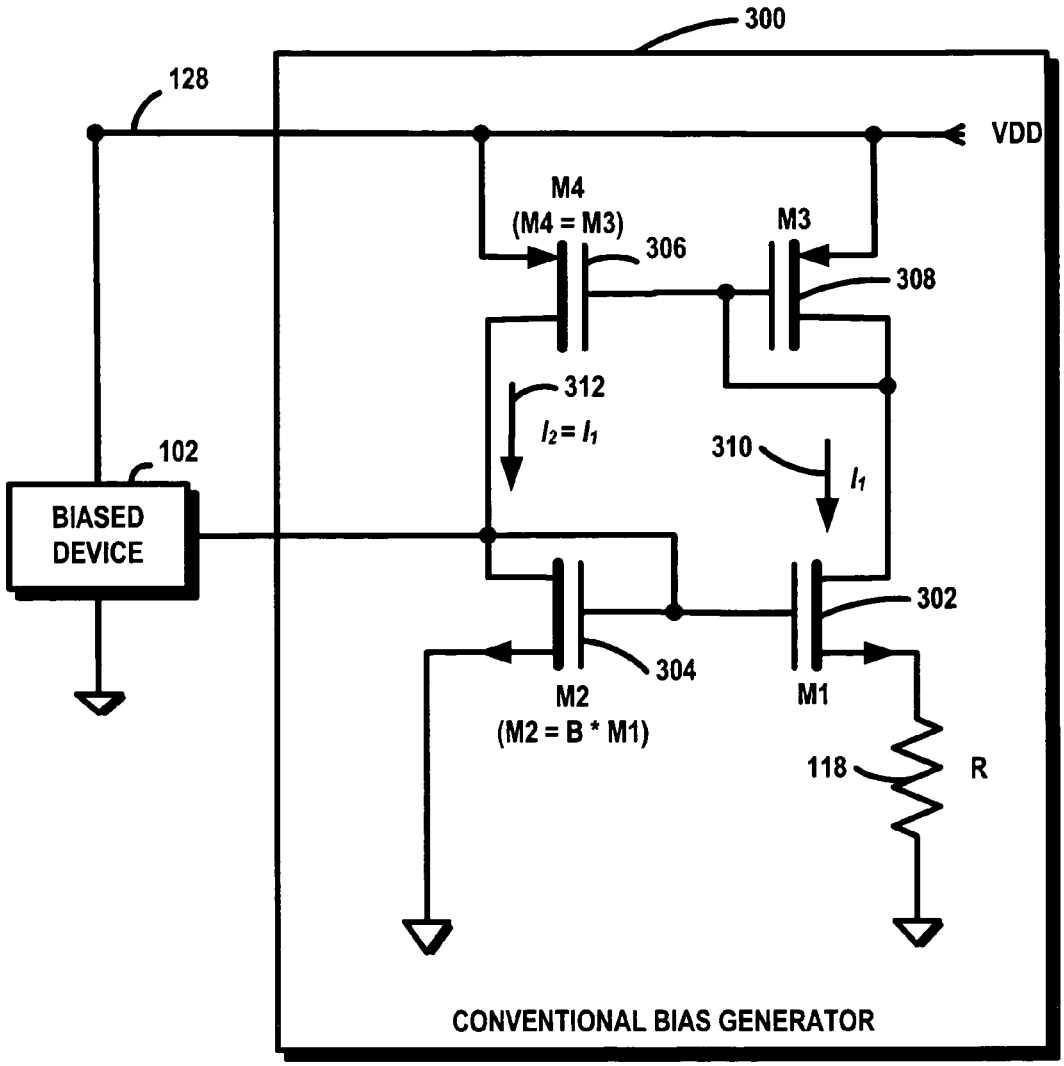
FIG. 3 PRIOR ART
FIG. 3 is a schematic diagram of a conventional bias generator.

FIG. 3 is a schematic diagram of a conventional bias generator 300. The conventional bias generator 300 includes four FETs 302, 304, 306, 308, where the gates of the first FET 302 and the second FET 304 are connected to each other and to the biased device 102. In order to maintain a constant bias over temperature and manufacturing variations, conventional bias generators 300 utilize transistors that have similar channel aspect ratios but that have significant different sizes. The third transistor 110 and the fourth transistor 112 are selected such that the size (M3) of the third transistor 110 is equal to the size (M4) of the fourth transistor 112 to force the same current ($I_1$=$I_2$) through the transistor pair 102, 104. In order to maintain a constant bias, the first transistor 102 and the second transistor 104 are selected such that the size of the first transistor is several times larger than the size of the second transistor. In addition, maintaining optimum performance requires the second transistor to be matched to the biased device 101. The second FET 304 is larger than the first FET 302 by a factor of B ($M_1$=B*$M_2$). The third FET and the fourth FET have the same size (M4=M3) and the first current ($I_1$) 310 through the first FET 302 is equal to the second current ($I_2$) 312 through the second FET 304. Typically, the transistors are selected such that the following relationships apply.

$$M_4 = M_3 \tag{5}$$

$$M_2 = N_f * \frac{W_f}{L_f} \tag{6}$$

$$M_1 = B * N_f * \frac{W_f}{L_f} \tag{7}$$

$$I = \frac{2}{R^2 * \mu_n * C_{ox} * N_f * \left(\frac{W_f}{L_f}\right)} * \left(1 - \frac{1}{\sqrt{B}}\right)^2 \tag{8}$$

Comparing the conventional bias generator 300 to the exemplary bias generator 100, it can be seen that the total current in the exemplary bias generator 100 is less than the total current in the conventional bias generator 300 for biasing the same biased device. The current savings is easily observed when applying values in the following example.

For the example, the biased device 102 has a channel width ($W_{biased}$) equal to 500 μm resulting in a bias current ($I_{biased}$) through the biased device 102 equal to 10 mA. For the comparison, scaling factors A and B are both equal to 4. In both the conventional bias generator 300 and the exemplary bias generator 100, the sizes ($M2_{Conv}$) ($M2_{EX}$) are ten times smaller than the biased device 102 and, therefore, the channel widths ($WM2_{Conv}$) ($WM2_{EX}$) of the second transistors 304, 106 are selected to be ten times smaller than the biased device width. Accordingly, $WM2_{Conv}$=$WM2_{EX}$=500 μm/10=50 μm. The current ($I_2$) through the second transistors 106, 304 is equal to 10 mA/10=1 mA. Since the current through the first transistor 302 in the conventional bias generator 300 it the same as the current through the second transistor 304, the current through the first transistor 302 is equal to 1 mA and the total current through the bias generator 300 is equal to 2 mA. The size ($M1_{Conv}$) of the first transistor 304, however, is four times smaller than the size ($M2_{Conv}$) of the second transistor 304 resulting in a channel width ($W_{M2Conv}$) equal to 12.5 μm. In the exemplary bias generator 100 discussed with reference to FIG. 2 above, however, the size (M1) of the first transistor 104 is the same as the size (M2) of the second transistor 106. Accordingly, the channel width ($W_{M1EX}$) of the first transistor 104 is equal to 50 μm. The current ($I_{1EX}$) through the first transistor 104 in the exemplary embodiment is at least partially determined by the third transistor 120. Since M4=A*M3, the current ($I_{1EX}$) through the first transistor 102 is equal to the current ($I_2$) through the second transistor 106 divided by the scaling factor (A) which is equal to 4 in the current example. Accordingly, the current ($I_{1EX}$) through the first transistor 104 is equal to 1 mA/4=250 μA. Therefore, the total current through the exemplary bias generator 100 for the example is equal to 1 mA+0.25 mA=1.25 mA which is about 12.5% of the current through the biased device 102. In comparison, the total current through the conventional bias generator 300 is 20% of the current through the biased device 102. In addition to having reduced current through the exemplary biased generator 100, the first transistor 104 is four times larger than the corresponding first transistor 302 of the conventional bias generator 300. As a result, the match between the biased device 102 and the biasing devices (104, 106 ) is improved resulting in better performance. In addition, conventional biasing techniques require matching between at least three transistors including the biased device 102, having size X, the second transistor 304, having size X/10 and the first transistor 302, having size X/40. In the exemplary bias generator 100, however, only one transistor size must be matched to the biased device 102, having size X, since both the first transistor 104 and the second transistor 106 has the same size, X/10.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A bias generator comprising:

a first transistor having a first input port, first output port and a first control port, where a voltage at the first control port determines a first current through the first transistor from the first input port to the first output port, a reference load connected from the first output port to a common potential;

a second transistor having a second input port and a second output port, and having a second control port connected to the first control port and the second input port, where the voltage at the first control port determines a second current through the second transistor from the second input port to the second output port control ports connectable to a biased device;

a first current source providing the first current; and a second current source providing the second current greater than the first current.

2. A bias generator in accordance with claim 1, wherein a first transistor size is the same as a second transistor size.

3. A bias generator in accordance with claim 2, wherein the first current source comprises a third transistor having a third input port, a third output port and a third control port connected to the third output port and wherein the second current source comprises a fourth transistor having a fourth input port, a fourth output port and a fourth control port connected to the third control port.

4. A bias generator in accordance with claim 3, wherein a fourth transistor size is greater than a third transistor size.

5. A bias generator in accordance with claim 4, wherein the fourth transistor size is at least twice the third transistor size.

6. A bias generator in accordance with claim 5, wherein the fourth transistor size is at least four times the third transistor size.

7. A bias generator in accordance with claim 4, wherein the first transistor, the second transistor, the third transistor and the fourth transistor are field effect transistors (FETs) and wherein the input ports are drains, the output ports are sources and the control ports are gates.

8. A bias generator in accordance with claim 1, wherein the second current is at least twice the first current.

9. A bias generator in accordance with claim 8, wherein the second current is at least four times greater than the first current.

10. A bias generator comprising:

a first field effect transistor (FET) having a first drain, first source, and a first gate, where a voltage at the first gate determines a first current through the first FET from the first drain to the first source, a reference load connected from the first source to a common potential;

a second FET having a second drain and a second source, and having a second gate connected to the first gate and the second drain, where the voltage at the first gate determines a second current through the second FET from the second drain to the second source, the gates connectable to a biased device having a device channel aspect ratio the same as a second FET channel aspect ratio of the second FET;

a third FET providing the first current; and a fourth FET providing the second current greater than the first current.

11. A bias generator in accordance with claim 10, wherein the second current is at least twice the first current.

12. A bias generator in accordance with claim 11, wherein the second current is at least four times the first current.

13. A bias generator in accordance with claim 10, wherein a fourth FET size is at least twice a third FET size.

14. A bias generator in accordance with claim 11, wherein a fourth FET size is at least four times a third FET size.

15. A bias generator comprising:

a first biasing means for biasing a biased device, the first biasing means having a first input port, first output port and a first control port, where a voltage at the first control port determines a first current through the first transistor from the first input port to the first output port, a reference load means for reference loading the first biasing means and connected from the first output port to a common potential;

a second biasing means for biasing the biased device, the second biasing means having a second input port and a second output port, and having a second control port connected to the first control port and the second input port, where the voltage at the first control port determines a second current through the second transistor from the second input port to the second output port control ports connectable to a biased device;

a first current source means for providing the first current; and a second current source means for providing the second current greater than the first current.

16. A bias generator in accordance with claim 15, wherein a first biasing means size is the same as a second biasing means size.

17. A bias generator in accordance with claim 16, wherein the first current source means comprises a third biasing means for biasing the biased device, the third biasing means having a third input port, a third output port and a third control port connected to the third output port and wherein the second current source means comprises a fourth biasing means for biasing the biased device, the fourth biasing means having a fourth input port, a fourth output port and a fourth control port connected to the third control port.

18. A bias generator in accordance with claim 17, wherein a fourth biasing means size is greater than a third biasing means size.

* * * * *